United States Patent [19]

Yates

[11] Patent Number: 4,618,425

[45] Date of Patent: Oct. 21, 1986

[54] PUMP FOR PUMPING CORROSIVE FLUIDS

[75] Inventor: Martyn R. G. Yates, Surrey, United Kingdom

[73] Assignee: Production Techniques Limited, Hampshire, England

[21] Appl. No.: 684,928

[22] PCT Filed: May 4, 1984

[86] PCT No.: PCT/GB84/00153

§ 371 Date: Dec. 17, 1984

§ 102(e) Date: Dec. 17, 1984

[87] PCT Pub. No.: WO84/04363

PCT Pub. Date: Nov. 8, 1984

[30] Foreign Application Priority Data

May 4, 1983 [GB] United Kingdom ..... 8312122

[51] Int. Cl.[4] ..... B01D 29/42

[52] U.S. Cl. ..... 210/416.1; 210/167; 210/196; 210/805; 417/473

[58] Field of Search ..... 210/416.1–416.5, 210/167, 196, 805; 417/118, 122, 473

[56] References Cited

U.S. PATENT DOCUMENTS

| | | | |
|---|---|---|---|
| 2,383,486 | 8/1945 | Isenberg et al. | 417/473 X |
| 2,563,862 | 8/1951 | Nechine | 210/416.1 X |
| 2,963,979 | 12/1960 | Eisenmann et al. | 210/416.1 |
| 3,182,597 | 5/1965 | Malizard et al. | 417/473 X |
| 3,283,911 | 11/1966 | Reise | 210/416.1 |
| 3,578,174 | 11/1971 | Karpacheva et al. | 210/416.1 |
| 3,610,416 | 10/1971 | Otto | 210/416.1 X |
| 3,637,331 | 1/1972 | Smith et al. | 210/416.1 X |
| 3,920,352 | 11/1975 | Speck et al. | 210/416.2 X |
| 4,277,333 | 7/1981 | Coppola | 210/416.3 X |

FOREIGN PATENT DOCUMENTS

| | | | |
|---|---|---|---|
| 2243027 | 3/1974 | Fed. Rep. of Germany . | |
| 3140742 | 4/1983 | Fed. Rep. of Germany . | |
| 2406096 | 5/1979 | France . | |
| 535977 | 4/1941 | United Kingdom | 417/473 |

OTHER PUBLICATIONS

Hawley, G. G.; *The Condensed Chemical Dictionary;* 8th Edition; Reinhold Co.; 1971; pp. 712, 713.

*Primary Examiner*—Richard L. Chiesa
*Attorney, Agent, or Firm*—Parkhurst & Oliff

[57] ABSTRACT

A submersible pump and filter unit for pumping and filtering acids comprises a removable pump cartridge (13) and filter unit (14) housed in respective cylindrical cavities (11, 12) in a housing (10). The pump cartridge (13) is a gas-driven double acting bellows unit with a cylindrical body (13A), the bellows (21, 22) and the body (13A) being formed of PTFE. Each bellows (21, 22) is at a respective end of a reciprocating rod (36) which is journaled coaxially in the body (13A) and which extends through a central aperture (16) in the body (13A). Control gear including a logic control valve (41) is housed in the aperture (16) and is thereby encased in PTFE structure and shielded from acid.

9 Claims, 4 Drawing Figures

PUMP FOR PUMPING CORROSIVE FLUIDS

DESCRIPTION

This invention is concerned with pumping corrosive fluids, such as acids used in etching or other production processes.

Apparatus which is used to etch microelectronic components during their manufacture includes open topped acid baths which are divided into primary and secondary compartments. The etching process takes place in the primary compartment. Resultant waste products surface and float on the acid in the primary compartment and are carried into the secondary compartment by some of the acid which flows over a weir which is formed by a barrier which separates the two compartments. A hood is provided above the bath to collect the acid fumes. The acid in the secondary compartment is pumped through a filter and the filtered acid is returned to the primary compartment.

If the pump, by which acid in the secondary compartment is pumped out of the secondary compartment through the filter, is driven by an electric motor which is supported above the level of acid in the bath, the life of the electric motor is short because of the corrosive effects of the acid fumes rising from the acid in the bath.

It is an object of this invention to minimize the corrosive effects of corrosive fluids, such as acids and/or their fumes upon operation of a pump by which the acid is pumped.

According to one aspect of this invention there is provided a pump for pumping corrosive fluids which comprises one group of parts which collectively comprise all the parts of the pump that are 'wetted' by corrosive fluids during use of the pump, all the parts of said one group being formed of a material which is resistant to corrosion by corrosive fluid which the pump is designed to pump, and including corrosive fluid displacement means operable to cause flow of corrosive fluid, and another group of parts including power operable motive means operable to drive the corrosive fluid displacement means and automatically operable control gear which controls operation of said motive means, wherein the pump is a submersible pump, said one group of parts also including the complete outer casing and motive power supply means connectable to an external source of motive power, and the other group of parts being wholly encased within structure which is formed by said one group of parts and thereby being shielded from contact by corrosive fluid which is pumped by the pump. Hence materials which are not resistant to the corrosive action of corrosive fluid that the pump is designed to pump can be used to form said other group of parts.

The power operable motive means may be gas powered in operation, said motive power supply means comprising gas supply conduit means for supplying working gas from a remote source of such gas under pressure through said structure to a working fluid space of said power operable motive means, there being exhaust gas conduit means provided for exhausting working gas from a working fluid space of the power operable motive means and for conveying exhausted working gas through said structure and away to a remote location during operation of the pump.

Conveniently the pump comprises a double acting bellows pump, the bellows of which function as said corrosive fluid displacemant means. The bellows pump may comprise a pump body forming two spaced chambers, a rod which slides within a bore between the chambers, a cup shaped bellows connected by its base at either end of the rod, each bellows being arranged with its side wall projecting from its base away from the rod so that the variable volume cavities formed by the two bellows are separated by the bases of the bellows and by the rod, each bellows being secured to the pump body so as to close a respective one of the chambers in a fluid-tight manner and form a respective one of the working fluid spaces therebetween, said motive power supply means and said exhaust gas conduit means comprising passages in the pump body for conveying working gas to each working fluid space which is formed between the respective bellows and the pump body and for exhausting working fluid gas from that space, and said automatically operable control gear comprising an automatically operable valve arrangement housed in a compartmant which is formed in the body between the two working fluid spaces and through which the rod passes, the valve arrangement being operatively associated with the rod whereby to change over the working gas and the exhaust connections to the working fluid spaces so as to effect reciprocating movement of the rod and the bases of the two bellows to respectively expand and contract the variable cavities and thereby pump corrosive fluid drawn from a reservoir into the variable volume cavities.

Preferably the assembly comprising the pump body and the two bellows comprises a removable cartridge located within a correspondingly-shaped cavity formed in a housing of a material which is resistant to the corrosive action of the fluid, there being a head plate by which the cartridge is enclosed within the housing, the head plate and the housing comprising the outer casing of the pump. Conveniently the housing forms a second cavity which houses a filter unit, the filter unit being removable from the second cavity as required. Conveniently passages are formed in the housing whereby a corrosive fluid inlet communicates with the two variable volume cavities via a respective non-return valve and the two variable volume cavities in turn communicate via a respective non-return valve with the filter containing cavity, there being an outlet port in communication with the outlet side of the filter unit.

According to another aspect of this invention corrosive fluid stored in a reservoir is circulated by being pumped from the reservoir by a gas-driven fluid displacement pump unit which incorporates its own gas powered driving means and which, together with those gas powered driving means, is immersed in the corrosive fluid in the reservoir and which has all its surfaces which are designed to be contacted by the corrosive fluid, formed of a material which is resistant to the corrosive action of the fluid, the working gas which provides the motive power for the pump being supplied to the pump from a remote source of such gas under pressure, parts of the pump unit which are not designed to be contacted by the corrosive fluid being wholly encased within structure which is formed by those parts of the pump unit that have surfaces that are designed to be contacted by the corrosive fluid and thereby being shielded from contact by corrosive fluid.

Preferably working gas exhausted from a working fluid space of the pump driving means during operation is exhausted from the pump unit and conveyed away to a location outside the reservoir. Corrosive fluid circulated by being pumped from the reservoir by operation of the pump unit is filtered by being pumped through a filter which is housed in a casing which houses the pump unit.

BRIEF DESCRIPTION OF THE DRAWINGS

One form of submersible pump and filter unit for pumping and filtering acids will be described now by way of example with reference to the accompanying drawings, of which.

DETAILED DESCRIPTION OF THE DRAWINGS

Figure 1:
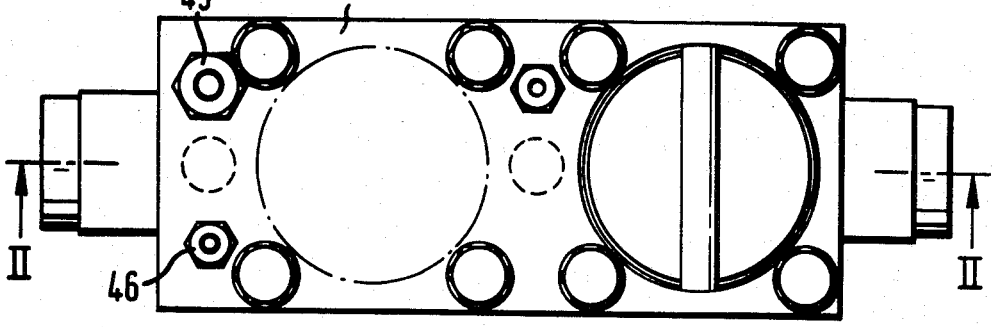
FIG. 1 is a plan view of the unit.
Figure 2:
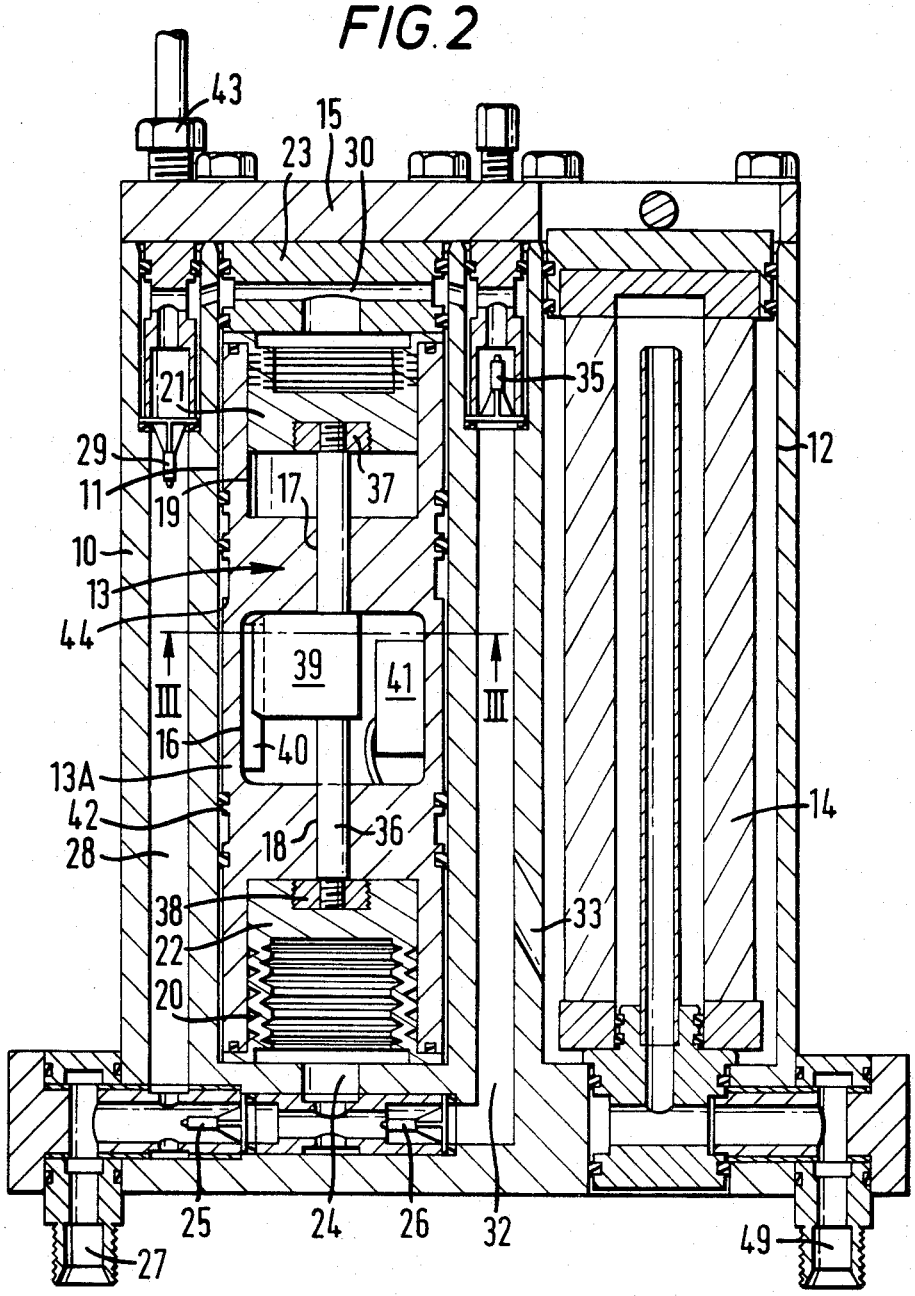
FIG. 2 is a section on the line II—II in FIG. 1.

FIGS. 1 and 2 show that the pump unit comprises a casing which is formed of PTFE. The casing comprises a housing 10 and a head plate 15.

Two parallel single ended bores 11 and 12 are formed in the housing 10. A cylindrical cartridge 13, which comprises a removable pump unit, is a sliding fit in the bore 11. A cylindrical filter element 14 is supported in a conventional manner within the single ended bore 12, with an annular space therearound.

The head plate 15 is fastened in a fluid-tight manner to the housing 10 so as to close the open end of the single ended bore 11. The head plate 15 is shown having a circular aperture formed in it in coaxial alignment with the single ended bore 12. A removable plug closes the bore 12, but no such aperture and removable plug need be provided; the head plate 15 may simply close the ends of both the single ended bores 11 and 12 if preferred.

The pump cartridge 13 comprises a cylindrical pump body 13A which has a substantially rectangular aperture 16 extending through it from side to side at its centre. Stepped axial bores extend from the aperture 16 to either end of the cylindrical body 13A, each stepped axial bore comprising a smaller diameter bore portion 17, 18 and a larger diameter end bore portion 19, 20 which opens at the respective end of the body 13A. A cup-shaped bellows 21, 22 is located loosely within a respective one of the two spaced chambers that comprise the end bore portions 19 and 20. The base of each cup-shaped bellows 21, 22 is nearer to the adjacent smaller diameter bore portion 17, 18 than to the open end, or mouth of the respective end bore portion 19, 20. The side wall portion of each bellows 19, 20, which is substantially cylindrical, extends from the base of the respective bellows 19, 20 through the mouth of the respective end bore portion 19, 20. Each bellows 21, 22 has a respective outwardly-projecting annular flange at its brim, the flange being trapped in a fluid-tight manner between the respective end face of the cylindrical body 13A and either the end wall of the single ended bore 11 or a manifold plug 23 which is located in a fluid-tight manner within the mouth of the single ended bore 11 by the head plate 15. Each annular flange serves as a fluid seal closing a cylinder space which is formed between the respective bellows 21, 22 and the body 13A within the respective end bore portion 19, 20.

A port 24 which is formed in the end wall of the single ended bore 11 at the closed end thereof, places the variable volume cavity formed within the adjacent bellows 22 in communication with a passage which extends between two non-return valves 25 and 26. The body 10 has an inlet 27 which communicates with the port 24, through the non-return valve 25, and with the variable volume cavity formed by the other bellows 21 through a passage 28 in the housing 10, a non-return valve 29 and an arm portion and the stem portion of a T-shaped passage 30 formed in the manifold plug 23. The passage 30 and the port 24 communicate with a passage 32 in the housing 10 respectively through a further non-return valve 35 or the non-return valve 26. The passage 32 communicates with the single ended bore 12 via a port 33.

The inlet 27, the non-return valves 25, 26, 29 and 35 and the bellows 21 and 22 are formed of PTFE. Each of the cylindrical wall portions of the bellows 21 and 22 has an axially spaced series of slits or grooves formed alternately in its inner and outer surfaces whereby it is axially extensible or contractable.

A rod 36 is a sliding fit in the two smaller diameter bore portions 17 and 18 and is fitted at either end to the respective bellows 21, 22 by being screwed at that end into an aluminium insert 37, 38 carried by the respective bellows 21 and 22 embedded in its base. A cam 39 is mounted on the rod 36 within the aperture 16. The cam 39 is formed with a groove at its end remote from the rod 36 and the groove receives a guide block 40 which is mounted on the body 13A in the aperture 16, whereby the rod 36 and the cam 39 are constrained for rectilinear movement.

A pilot-operable change-over valve 41 is also mounted on the body 13A within the aperture 16. It has an input pressure port to which motive gas under pressure is led through a suitable gas supply conduit. The gas supply conduit comprises a drilling in the housing 10. That drilling communicates at one end with an annular cavity which is formed by a circumferential groove 42 in the outer surface of the cylindrical body 13A and at its other end with a passage through the head plate 15 leading to a tubular nut 43. A PVC pipe extends from the nut 43.

Figure 3:
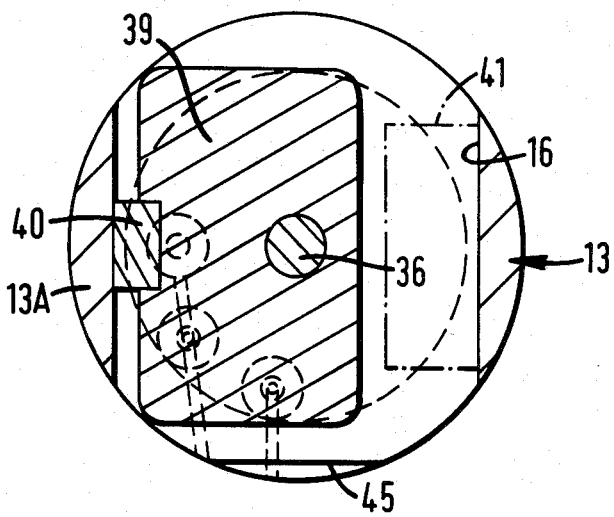
FIG. 3 is a section of the pump body of the unit shown in FIGS. 1 and 2 taken on the line III—III in FIG. 2.
Figure 4:
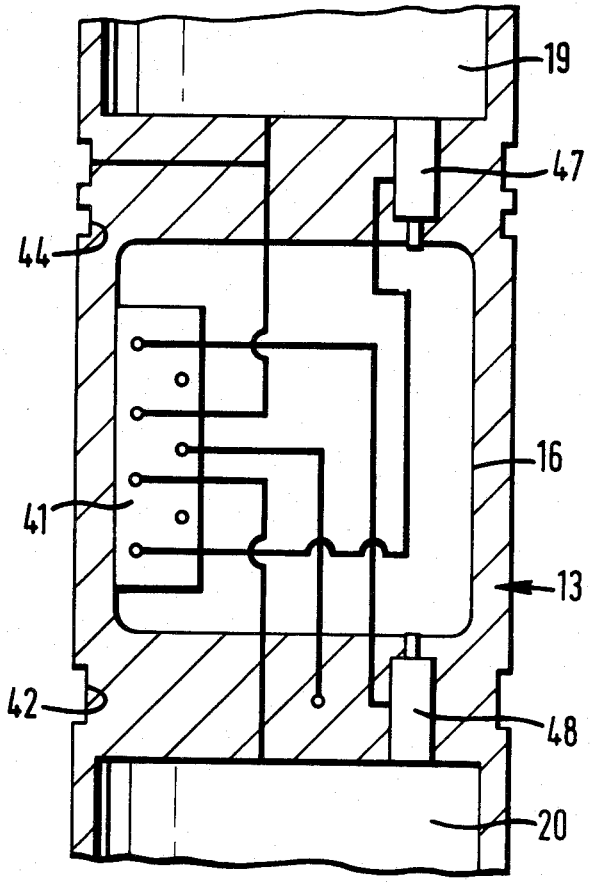
FIG. 4 is a diagram illustrating the working gas circuitry within the pump unit.

FIG. 4 shows that each of two of the other ports of the valve 41 is connected to a respective one of the end bore portions 19 and 20 by suitable PVC piping and drillings through the body 13A. Two further ports in the valve 41 vent into the space formed by the aperture 16. That space communicates with an annular cavity formed by a circumferential groove 44 formed in the outer surface of the cylindrical body 13A via a space which is formed by a flat 45 (see FIG. 3) formed in the outer cylindrical surface of the body 13A between the aperture 16 and the groove 44. The annular cavity formed by the groove 44 communicates with another drilling through the housing 10 which leads to an exhaust port in the head plate 15, that exhaust port being formed by a tubular nut 46 (see FIG. 1). An exhaust pipe formed of PTFE leads from the exhaust port. Hence an exhaust path for gases exhausted from either working fluid space formed within the end bore portions 19 and 20 is provided by the space formed by the flat 45 and the circumferential groove 44, the drilling with which it communicates, the tubular nut 46 and the exhaust pipe leading therefrom.

Two pairs of axially-spaced 'O'-ring seals fitted into annular grooves in the cylindrical surface of the body 13A cooperate with the wall of the cylindrical cavity 11 to seal the aperture 16 and the annular groove 44 from the ends of the cavity 11 around the chambers 19 and 20.

A plunger-operable normally-closed vent valve 47, 48 is mounted in the body 13A at either end of the aperture 16 so that its respective plunger projects into the aperture 16, the two valves 47 and 48 being substantially coaxial. Each valve 47, 48 also communicates with a respective one of the end bore portions 19 and 20 and controls communication between that end bore portion 19, 20 and the space formed by the aperture 16. The cam 39 is aligned with the plungers of the two valves 47 and 48 and reciprocates between them depressing the respective plunger of each valve 47, 48 to open the valve 47, 48 at the respective end of its path of reciprocal movement. The outlet port of each valve 47, 48 is connected by a respective PTFE pipe to a respective pilot input port of the valve 41 as shown in FIG. 4.

In use of the pump filter unit, the casing is inserted into an open topped reservoir of acid to be filtered so that it is immersed in that fluid. The PTFE pipes connected to the tubular nuts 43 and 46 are led out of the reservoir, the working gas input pipe being connected to a suitable source of working gas under pressure and the exhaust pipe being led to a suitable location for venting the exhaust gas.

The valve 41 is arranged so that the supply of working gas under pressure fed into the pump unit and to the pressure port of the valve 41 is connected through the valve 41 to the end bore portion 19, 20 which accommodates the bellows 21, 22 that is axially extended (viz. the bellows 22 in the condition of the pump as shown in FIG. 2). Working gas under pressure supplied to that end bore portion acts to compress the bellows 21, 22 and displace acid from its variable volume pump chamber through the respective non-return valve 26, 35, the passage 32 and the port 33 into the single ended cylinder 12 and through the filter element 14 to an outlet 49 from where it is returned to the acid reservoir. Such movement of the contracting bellows 21, 22 under the action of the working gas pressure draws the rod 36 and the cam 39 with it and thus causes extension of the other bellows 21, 22 and displaces gas from the respective end bore portion 19, 20 through the passages and conduit connections by which that end bore portion 19, 20 communicates with a respective port of the valve 41. That gas is exhausted from the valve 41 through the respective exhaust port into the space formed by the aperture 16 and from that space via the exhaust path described above. The cam 39 abuts the plunger of a respective one of the plunger operated valves 47 and 48 as it approaches the end of its path of reciprocal movement. In consequence a pulse of gas is transmitted from that valve 47, 48 to the respective pilot port of the valve 41 to change over the state of the valve 41 and reverse the connections of working gas under pressure to the other end bore portion 19, 20 so that reverse movement of the two bellows 21 and 22 and the rod 36 between them is effected. Thus acid that had been drawn into the variable volume chamber of the respective bellows 21, 22 as that bellows 21, 22 was being extended is now displaced from that variable volume chamber by contraction of that variable volume chamber and further acid is drawn into the variable volume chamber of the other bellows 21, 22 as that bellows 21, 22 is being extended. As before acid displaced from the variable volume chamber of the contracting bellows 21, 22 is displaced through the respective non-return valve 26, 35 into the single ended cylinder 12 and through the filter element 14 to the outlet 49.

Although the non-return valves 25, 26, 29 and 35 are shown to be simple check valves, the use of magnetically-biassed check valves in their stead is preferred. A suitable magnetically-biassed check valve comprises a needle type poppet valve formed of PTFE with a bar magnet embedded in it coaxially. The valve cooperates with a valve seat and is located in a bore downstream of an orifice formed by the valve seat. An annular magnet having axially spaced poles of opposite polarity to the bar magnet is embedded in a valve housing in which the bore is formed so as to coaxially surround that bore and the poppet valve adjacent the valve seat. The housing is formed of PTFE. The magnetic field biases the poppet valve to seat and close the orifice in static flow conditions.

I claim:

1. A submersible pump for pumping corrosive fluids which comprises one group of parts which collectively comprise all the parts of the pump that are wetted by corrosive fluids during use of the pump, all the parts of said one group being formed of a material which is resistant to corrosion by corrosive fluid which the pump is designed to pump and including corrosive fluid displacement means operable to cause flow of corrosive fluid, said pump having a complete outer casing and motive power supply means connectable to an external source of motive power; and another group of parts which is wholly encased within structure which is formed by said one group of parts and thereby is shielded from contact by corrosive fluid which is pumped by the pump, and which includes power operable motive means operable to drive the corrosive fluid displacement means, characterized in that said pump is gas driven reciprocatory double acting bellows pump, the bellows of which bound respective working fluid spaces of said power operable motive means and function as said corrosive fluid displacement means, and said motive power supply means comprise gas supply conduit means for supplying working gas from a remote source of such gas under pressure through said structure to either working fluid space, there being exhaust gas conduit means provided for exhausting working gas from the other working fluid space and for conveying exhausted working gas through said structure and away to a remote location during operation of the pump.

2. A submersible pump according to claim 1, comprising a pump body forming two spaced chambers, a rod which slides within a bore between the chambers, a cup-shaped bellows connected by its base at either end of the rod and together comprising the bellows of the pump, each bellows being arranged with its side wall projecting from its base away from the rod so that the variable volume cavities formed by the two bellows are separated by the bases of the bellows and by the rod, each bellows being secured to the pump body so as to close a respective one of the chambers in a fluid tight manner and form a respective one of the working fluid spaces therebetween, said motive power supply means and said exhaust gas conduit means comprising passages in the pump body for conveying working gas to each working fluid space which is formed between the respective bellows and the pump body and for exhausting working fluid gas from that space.

3. A submersible pump according to claim 2, wherein the assembly comprising the pump body and the two bellows comprises a removable cartridge located within a correspondingly-shaped cavity formed in a housing of a material which is resistant to the corrosive action of the fluid, there being a head plate by which the cartridge is enclosed within the housing, the head plate and the housing comprising the outer casing of the pump.

4. A submersible pump according to claim 3, wherein the housing forms a second cavity which houses a filter unit, the filter unit being removable from the second cavity as required.

5. A submersible pump according to claim 4, wherein passages are formed in the housing whereby a corrosive fluid inlet communicates with the two variable volume cavities via a respective non-return valve and the two variable volume cavities in turn communicate via a respective non-return valve with the second cavity, there being an outlet port in communication with an outlet side of the filter unit.

6. A submersible pump according to claim 2, including automatically operable control gear comprising an automatically operable valve arrangement housed in a compartment which is formed in the body between the two working fluid spaces and through which the rod passes, the valve arrangement being operatively associated with the rod whereby to change over the working gas and the exhaust connections of the working fluid spaces so as to effect reciprocating movement of the rod and the bases of the two bellows to respectively expand and contract the variable volume cavities and thereby pump corrosive fluid drawn from a reservoir into the variable volume cavities.

7. A submersible pump according to claim 6, wherein the assembly comprising the pump body and the two bellows comprises a removable cartridge located within a correspondingly-shaped cavity formed in a housing of a material which is resistant to the corrosive action of the fluid, there being a head plate by which the cartridge is enclosed within the housing, the head plate and the housing comprising the outer casing of the pump.

8. A submersible pump according to claim 7, wherein the housing forms a second cavity which houses a filter unit, the filter unit being removable from the second cavity as required.

9. A submersible pump according to claim 8, wherein passages are formed in the housing whereby a corrosive fluid inlet communicates with the two variable volume cavities via a respective non-return valve and the two variable volume cavities in turn communicate via a respective non-return valve with the second cavity, there being an outlet port in communication with an outlet side of the filter unit.

* * * * *